United States Patent [19]

Steiner

[11] 4,113,423

[45] Sep. 12, 1978

[54] TORCH IGNITER

[76] Inventor: H. Karl Steiner, 3224 S. 92nd St., Milwaukee, Wis. 53227

[21] Appl. No.: 761,667

[22] Filed: Jan. 24, 1977

[51] Int. Cl.[2] ..... F23Q 3/00

[52] U.S. Cl. ..... 431/128; 431/256; 431/263

[58] Field of Search ..... 431/127, 128, 263, 264, 431/256

[56] References Cited

U.S. PATENT DOCUMENTS

| | | | |
|---|---|---|---|
| 1,915,446 | 6/1933 | Pressler | 431/128 |
| 3,801,260 | 4/1974 | Irwin | 431/128 |

FOREIGN PATENT DOCUMENTS

| | | | |
|---|---|---|---|
| 29,613 of | 1913 | United Kingdom | 431/128 |

*Primary Examiner*—Edward G. Favors
*Attorney, Agent, or Firm*—Ira Milton Jones & Associates

[57] ABSTRACT

An igniter for acetylene torches having ignition means protectively housed in a box-like metal enclosure that has an inwardly depressible hinged wall, depression of which activates the ignition means. A guarded opening through the depressible hinged wall provides a passageway through which gas issuing from a torch may be projected into the vicinity of the ignition means, so that by positioning the nozzle of the torch to project the jet of gas issuing therefrom into the inlet of the guarded opening and, at the same time, applying inward pressure on the hinged wall, the torch is ignited. Located within the enclosure are two solenoid-actuated valves which control the admission of gas and oxygen to the torch, and an upwardly biased depressible torch supporting hook on the exterior of the enclosure holds a normally closed switch that controls energization of the solenoids of the valves, in its open condition as long as the torch is supported by said hook. In one of the disclosed embodiments of the invention, an electric spark gap which is connected with a current source by inward movement of the hinged wall of the enclosure, provides the ignition means. In another embodiment of the disclosed invention, a gas burner forms the ignition means. In this case, a small pilot light is maintained at the burner until the hinged wall of the enclosure is depressed, whereupon the gas supply to the burner is abruptly increased to produce a flame large enough to ignite the torch.

13 Claims, 10 Drawing Figures

21
20
17
23
30
18
19
22
29
4
28
14
25
26
27
10
13
8
11
11'
8'
9'
15
4

4
8
9
29
14
10
13
15
26
27
25
26
11'
11
8'
9'
29

Fig. 8
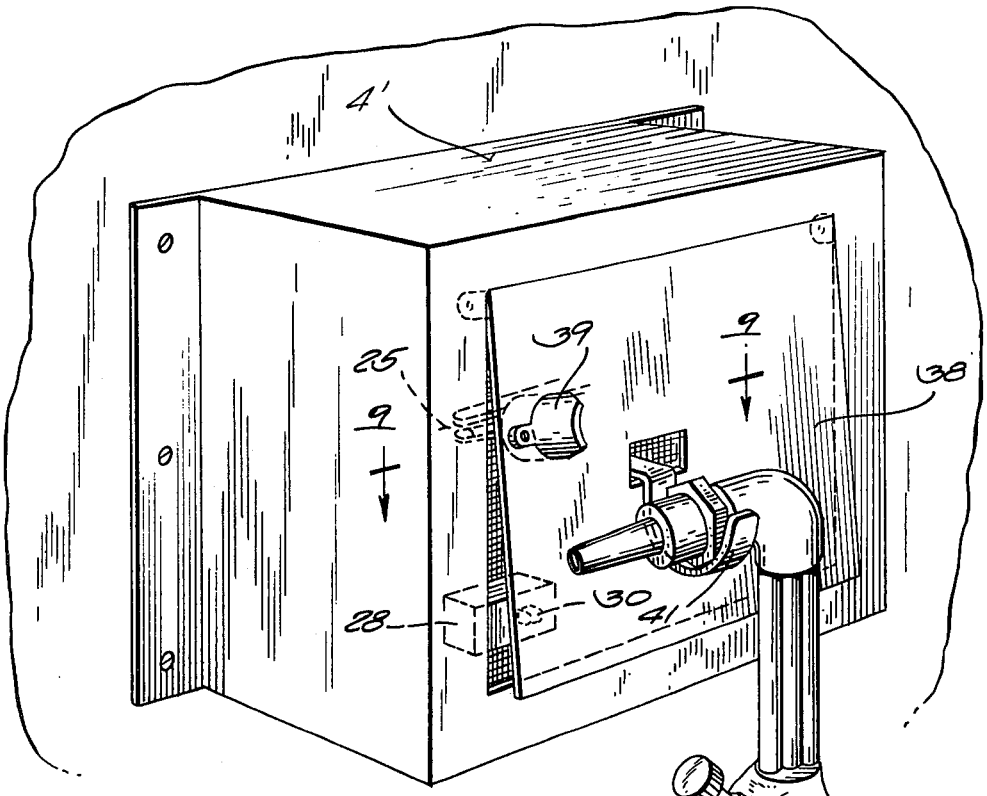
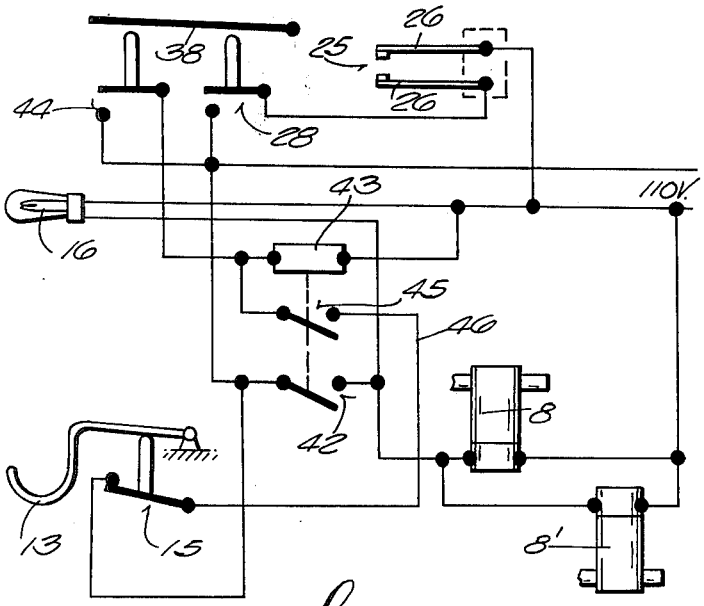
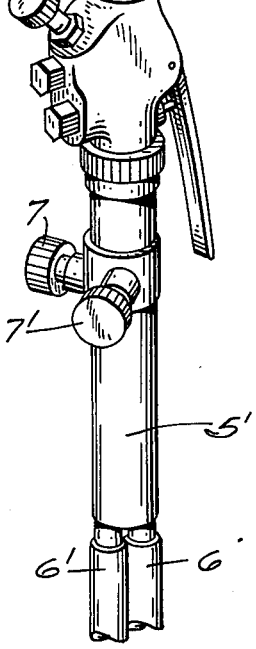
Fig. 10

TORCH IGNITER

This invention relates to an igniter for acetylene torches and has as its object the provision of an igniter with which a conventional hand-held torch can be lit by simply touching the tip or nozzle of the torch to an easily depressible trigger plate on the igniter.

Another object of the invention is the provision of an igniter by which instantaneous ignition of the torch can be obtained under full operating gas pressure.

It is also an object of this invention to provide a convenient gas torch accessory which not only enables the operator to instantaneously light the torch without requiring the use of both hands, but also eliminates the need for manually turning the gas on and off and adjusting the proportions of its constituent elements, i.e. acetylene gas and oxygen.

An especially welcome attribute of this invention — in addition to the convenience and safety that characterizes its use — resides in the savings in gas consumption it makes possible. This latter advantage stems from the incorporation in the igniter of solenoid actuated valves that control the admission of gas to the torch, and the provision of a switch in the energizing circuit of the valve solenoids that is opened by placing the torch on a storage hook on the exterior of the device, and closed when the torch is lifted off of that hook.

Another ingenious feature of the invention resides in its provision of a simple but highly effective means for breaking up any fine unvaporized particles contained in the gas issuing from the nozzle of the torch before the gas reaches the ignition point.

While in the preferred embodiment of the invention ignition is effected by an electric spark that occurs across a spark gap the instant the trigger plate of the device is lightly touched by the tip or nozzle of the torch, in another embodiment of the invention the same instantaneously available ignition is obtained from a pilot-lit gas flame that flashes into being in response to actuation of a similar trigger device.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of the embodiments of the invention constructed according to the best modes so far devised for the practical application of the principles thereof, and in which:

FIG. 1 is a perspective view of an igniter constructed in accordance with an embodiment of the invention, in which ignition is produced by an electric spark across a pair of electrodes, and solenoid-actuated valve control the flow of gas and oxygen to the torch;

FIG. 2 diagrammatically illustrates the elements of the igniter shown in FIG. 1;

Figure 6:
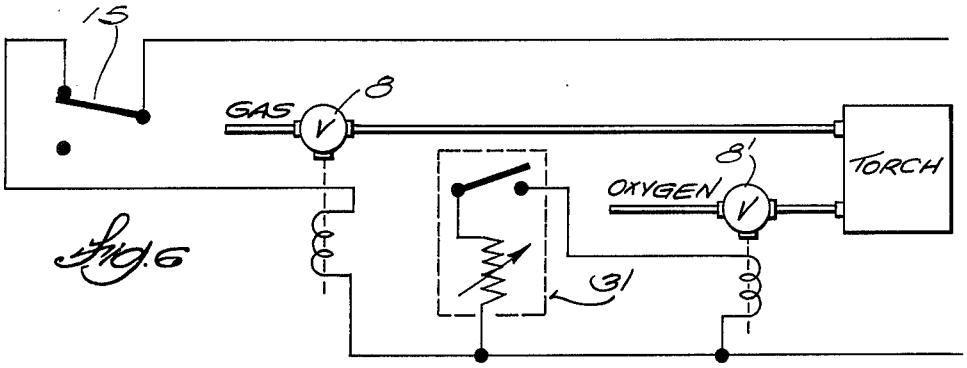
Figure 7:
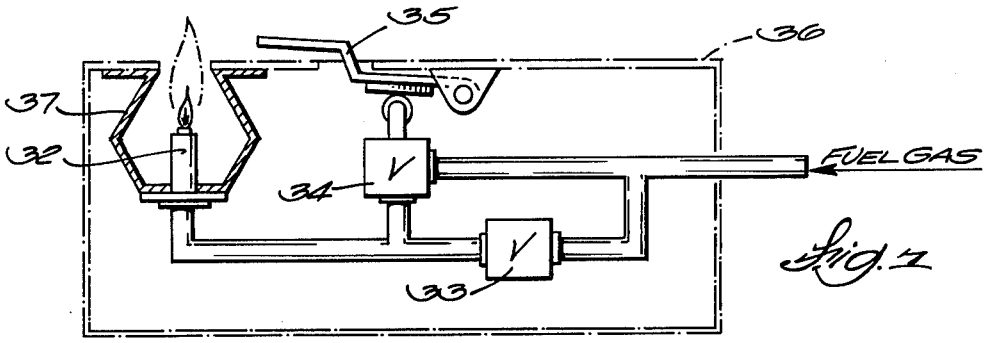
Figure 9:
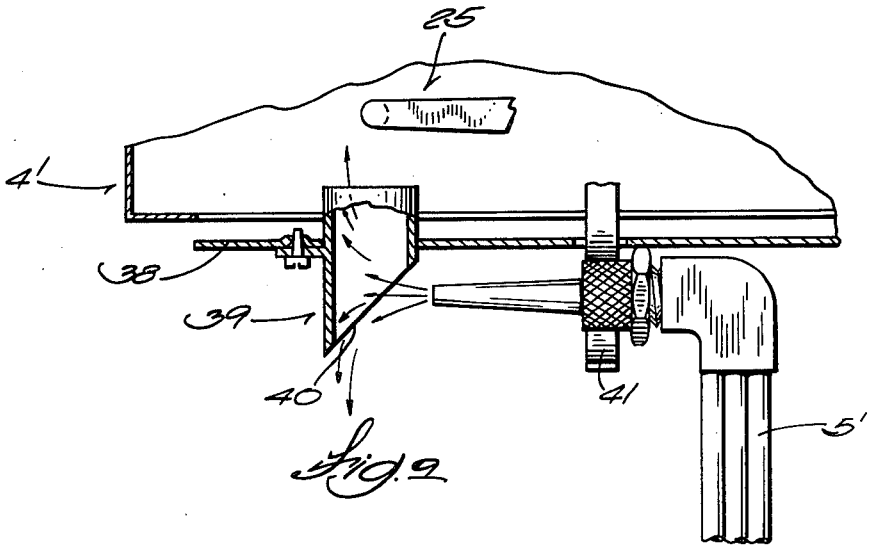

FIG. 6 diagrammatically illustrates the incorporation in the control system for the solenoid-actuated gas and oxygen valves, of means for effecting sequential opening of the valves;

FIG. 7 more or less diagrammatically illustrates a modified embodiment of the invention wherein the ignition means is a flame burning at a gas burner, as distinguished from the electric spark employed in that embodiment of the invention shown in FIGS. 1-5;

FIG. 8 is a perspective view of an embodiment of the invention that is especially adapted for use with heavy-duty metal cutting torches;

FIG. 9 (on sheet 4) is a detail sectional view through FIG. 8 on the plane of the line 9—9; and FIG. 10 diagrammatically illustrates the electrical control circuits of that embodiment of the invention depicted in FIGS. 8 and 9.

Referring to the accompanying drawings and considering first the preferred embodiment of the invention illustrated in FIGS. 1 through 5, the numeral 4 identifies a metal case or box-like enclosure in which the mechanism of the igniter is housed, and the numeral 5 designates a conventional hand-held acetylene torch to which acetylene gas and oxygen is supplied by a pair of hoses 6—6'. As is customary, the torch has manually adjustable valves 7—7' by which the proportions of acetylene gas and oxygen issuing from the torch may be regulated.

If the connection of the hoses 6—6' with gas and oxygen supply tanks is direct, the valves 7—7' must be manually opened and adjusted to obtain optimum proportions of gas and oxygen every time the torch is to be used, and closed when the job is done. This invention eliminates that obvious inconvenience by virtue of its incorporation of a pair of solenoid actuated valves 8—8' in series with the torch and the supply tanks. For that purpose, nipples 9—9' that lead from the inlet ports of the valves and project from one of the upright walls of the case — which may be considered its rear wall — and connectable with gas and oxygen supply tanks (not shown) and nipples 11—11' that provide the outlet ports of the valves, project from a side wall 12 of the case and have the hoses 6—6' attached thereto. It follows, therefore, that when the valves 8—8' are opened, both gas and oxygen in proportions set by the adjustment of the valves 7—7' flow at full pressure to the torch.

Figure 1:
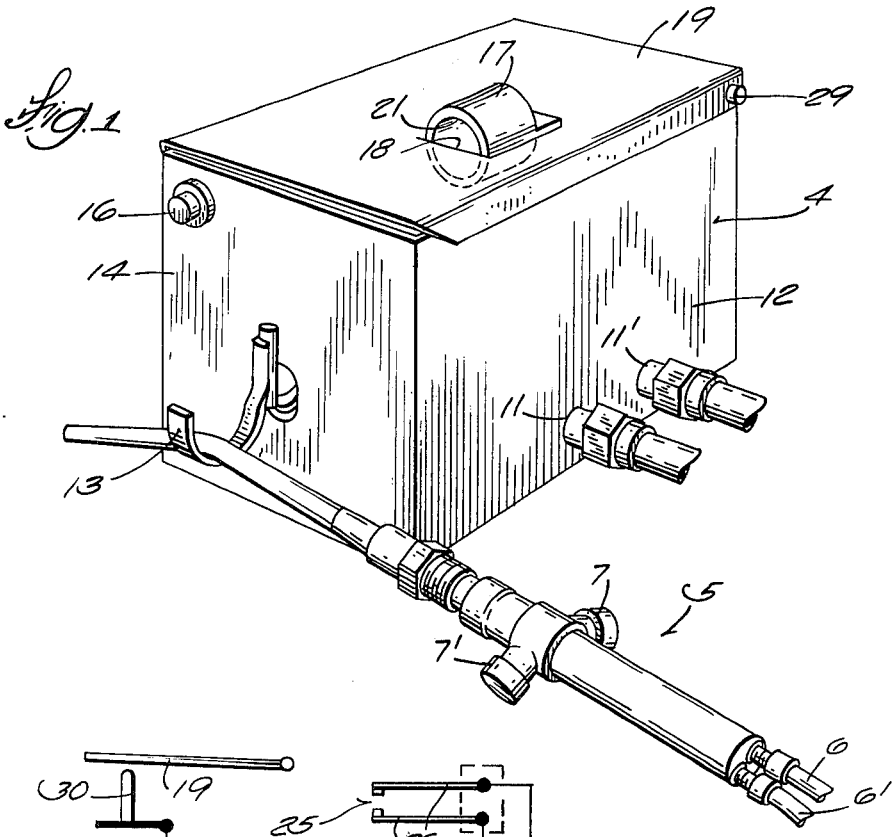
Figure 2:
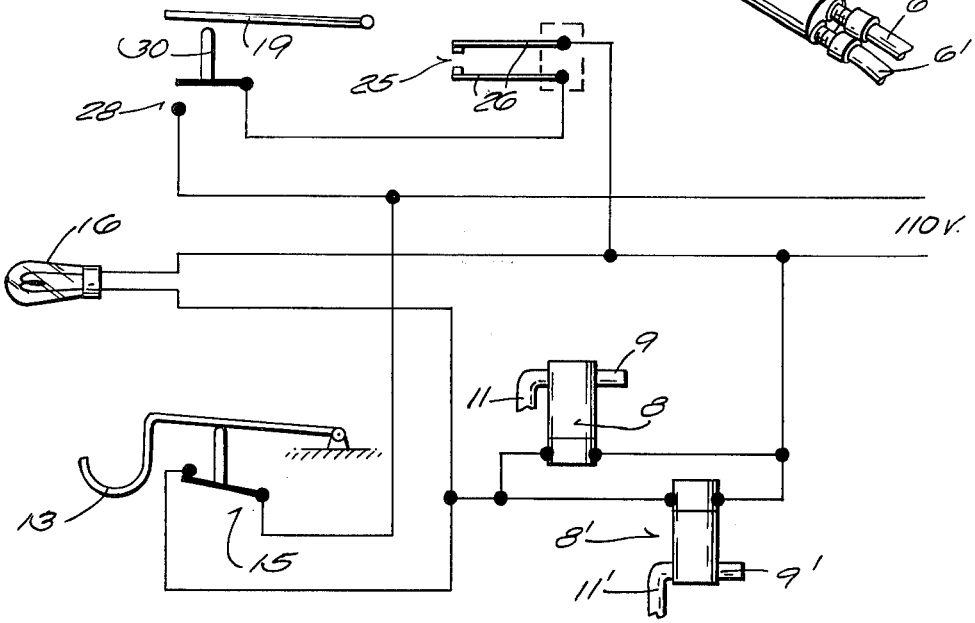
Figure 3:
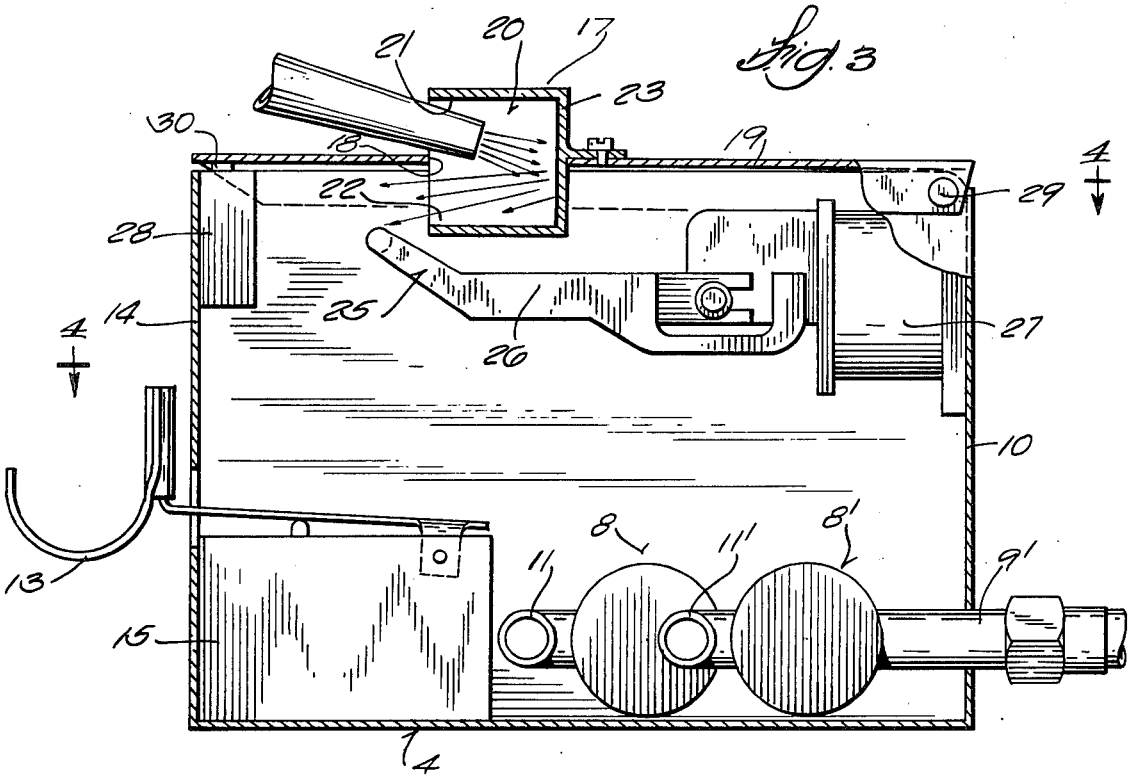
FIG. 3 is a side view with parts broken away and in section, of the igniter shown in FIG. 1.
Figure 4:
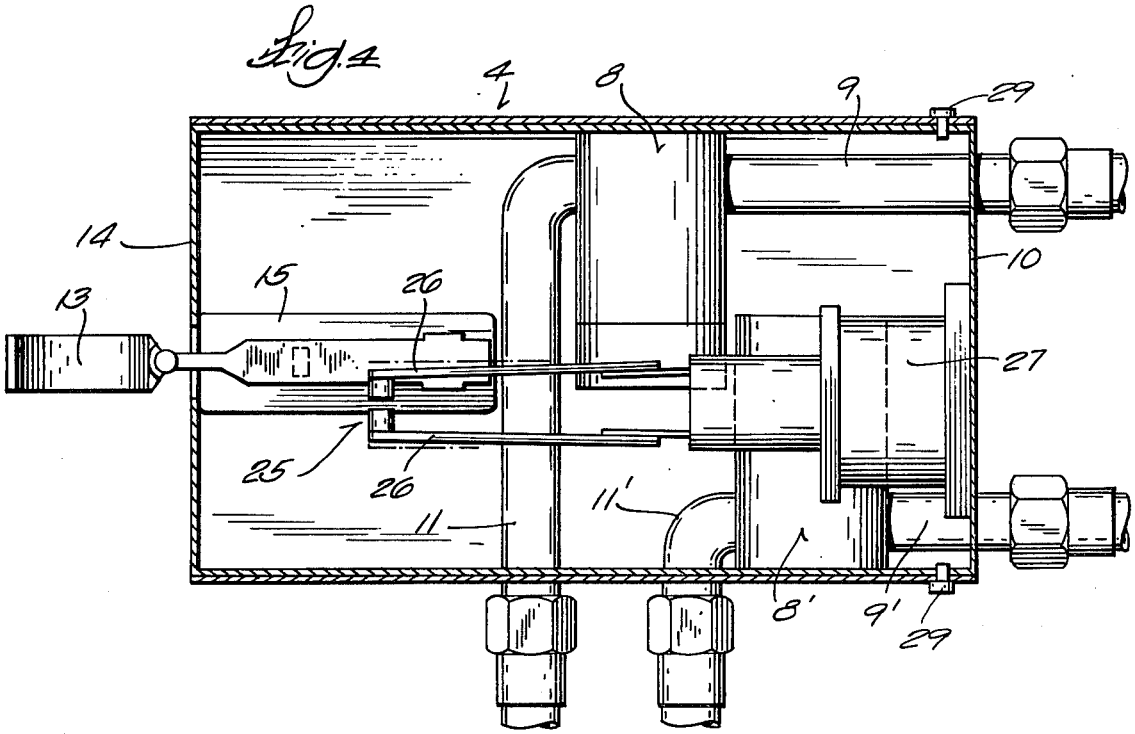
FIG. 4 is a horizontal sectional view through FIG. 3 on the planes of the line 4—4.
Figure 5:
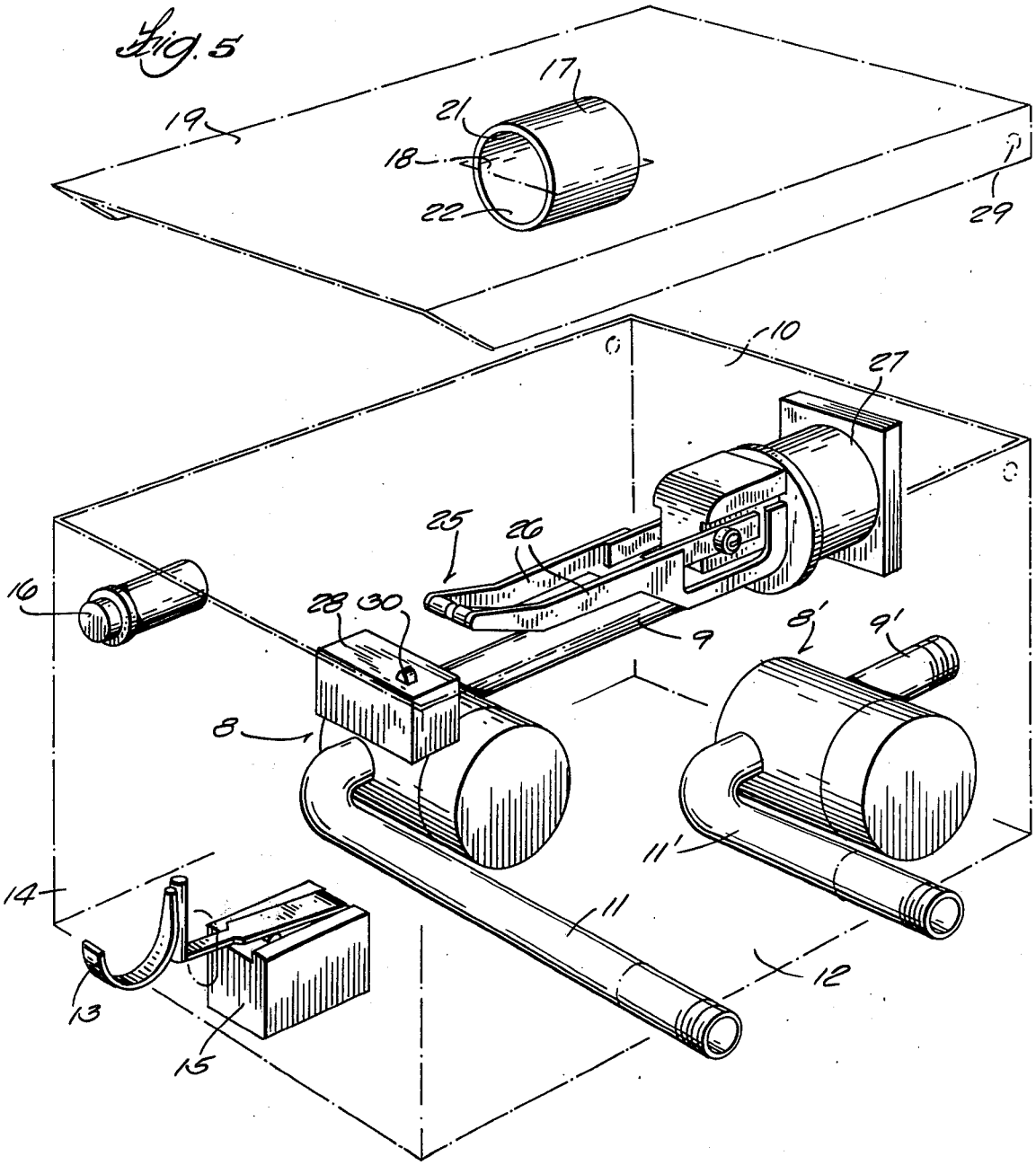
FIG. 5 is a phantom perspective view of the igniter shown in FIG. 1.

The valves 8—8' are of the normally closed type and are opened by energization of their respective solenoids. This occurs automatically whenever the torch is lifted off a hook or support 13 that projects from the front wall 14 of the case. The hook is pivotally mounted inside the case and is biased upwardly with a force insufficient to support the weight of the torch. Hence, as best shown in FIG. 2 whenever the torch rests upon the hook, a switch 15 with which the hook is mechanically connected, is open; and when the torch is lifted off the hook, that switch is closed. The switch 15 is connected in series with the solenoids of the valves 8—8' and thus controls their energization.

The switch 15 is also connected in series with a pilot light 16 on the front wall of the case which, when lit by closure of the switch, indicates that the torch is connected with the gas and oxygen supply.

To light the torch, its tip or nozzle is positioned to direct the gas issuing therefrom into the mouth of a metal cup 17 set into a hole 18 in the top wall 19 of the case and suitably fixed to the wall. The mouth of the cup faces forwardly and is bisected by the front edge of the hole 18. The front edge portion of the hole thus coacts with the cup to define a tortuous passageway 20 into the interior of the case that has a forwardly facing inlet 21 above the top wall 19 and a forwardly facing exit 22 below the top wall. A jet of gas issuing from the nozzle or tip of the torch and projected into the inlet 21 at a slight downward angle will impinge upon the bottom 23 of the cup and bounce off of it towards and through the exit 22.

A short distance below the top wall of the case at a location between its front wall 14 and the front edge of the hole 18, is a spark gap 25 defined by a pair of electrodes 26 that are suitably mounted in the case. By virtue of this location of the spark gap, gas issuing from the exit 22 of the passageway 20 will be ignited by a spark across the gap. To produce the spark the electrodes are electrically connectable with a high tension coil 27 by closure of a switch 28.

Closure of the switch 28 is effected by downward pressure on the top wall 19 which has its rear edge hingedly connected, as at 29, to the sidewalls of the case and its forward portion resting on the actuator button 30 of the switch 28. Since the switch is mounted on the front wall 14 of the case, with its upwardly biased actuator button projecting a short distance above the top edge of the front wall, downward pressure on the top wall depresses the button and closes the switch. Only a relatively light downward force applied to the top wall is sufficient to depress the actuator button and thereby close the switch. Accordingly, by merely resting the tip or nozzle of the torch on the top wall as it is placed in position to direct the gas issuing therefrom into the mouth of the cup 17, the switch 28 is closed.

Thus, in one simple movement, the operator can lift the torch off the hook (which automatically results in the flow of gas at full pressure from the nozzle of the torch), activate the ignition spark and direct the jet of gas issuing from the torch onto the spark to be ignited thereby.

Because of the ease with which the torch can be lit, there is no deterrent to shutting it off as soon as a task requiring its use is finished; and this, of course, merely requires replacing the torch on the storage hook 13.

A significant feature of the invention is the assurance it provides against the possibility of physically contacting the electrodes 26 with the tip of the torch — or, for that matter, with any tool or thing that could be inserted into the inlet 21 of the passageway 20. The tortuous back and forth path defined by that passageway makes such contact impossible — or at least highly improbable.

The tortuous shape of the passageway 20 has still another virtue. It prevents unvaporized particles that might be present in the gas issuing from the torch from reaching the vicinity of the spark gap. The collision of such particles with the bottom 23 of the metal cup 17 very effectively breaks up those particles and thus makes ignition more positive.

Also, since the cup 17 is made of copper, it quickly dissipates the heat that results from ignition of the torch.

It has been found that, when both solenoid valves 8—8' are opened simultaneously, ignition of the torch is accomplishes by a loud explosive noise — no doubt because the opening of those valves results in the gas and oxygen reaching the nozzle under full pressure. That objectionable condition can be eliminated — or at least greatly diminished — by opening the gas valve slightly before the oxygen valve is opened. For this purpose, as shown in FIG. 6, a time delay relay 31 is connected in the energizing circuit of the solenoid for the oxygen valve 8'. This relay may be of any conventional type, but should be adjustable so that the time lag it accomplishes in the opening of the oxygen valve can be set in relation to the length of the hoses leading to the torch, and to the operating pressure.

If the valves are opened manually, as in the modified embodiment of the invention about to be described, a lost-motion connection between the valve-opening mechanism and the oxygen valve can be employed to gain the desired sequential opening of the two valves.

While the use of an electric spark to ignite the torch is no doubt the preferred way of doing so, the desired quick and easily effected ignition of the torch also can be accomplished with the "all gas" modified version of the invention, illustrated in FIG. 7. As there shown, a small pilot flame is kept burning at a gas burner 32 by connecting the burner with a gas supply through an adjustable valve 33. A second normally closed valve 34 which controls a main supply line to the burner, is operatively connected with a depressible trigger in the form of a pivoted lever 35.

The outer free end portion of the lever 35 projects through a hole in the top wall of the case 36 (shown in dotted lines) that houses the burner and the valves and is located adjacent to the mouth of a cup-like shield 37 for the pilot light. Thus, upon depression of the lever 35 with the tip or nozzle of the torch as it is positioned to direct the jet of gas issuing therefrom into the cup-like shield, the valve 34 is opened and as a result the flame at the burner flares up and ignition of the torch is instantaneously accomplished.

Since no provision is made in the modified embodiment of the invention shown in FIG. 7 for controlling connection of the torch with a gas supply, the operator would, of course, have to open and close the control valves 7—7' on the torch, but at least ignition of the torch would be more easily obtained than with prior expedients which required the use of both hands.

The embodiments of the invention thus far described are admirably suited for use with relatively light brazing torches, but for heavy duty cutting torches it is preferable to embody the invention in the more rugged form shown in FIGS. 8, 9 and 10, since such torches are relatively large and heavy. In this form of the invention, the box-like housing or case 4' is arranged to be mounted on a vertical wall, and its front wall 38 is hingedly supported at its upper edge. Accordingly, the switch 28 by which the electrodes of the spark gap are connected across the high tension coil, is so mounted that its actuator button 30 holds the hinged front wall 38 in an outwardly swung orientation. As before, inward depression of the hinged wall activates the ignition means, but since the gas issues from the torch in far greater volume than it does from the smaller brazing torch, the inlet passage leading to the vicinity of the spark gap is designed to direct only a portion of the gas issuing from the torch into the box-like enclosure. To this end, the gas inlet passage is in the form of a tube 39 mounted on and passing through the hinged wall 38 with its inner end adjacent to the spark gap. The outer end of the tube 39 is mitered or cut at an acute angle to the axis of the tube so that diametrically opposite portions of the outer edge 40 of the tube are spaced different distances from the wall 38, giving the mouth of the tube an inclined disposition.

Accordingly, when the torch is held against the hinged wall with its nozzle or tip facing the inclined mouth of the tube, as shown in FIG. 9, the gas issuing from the torch impinges upon the inner wall of the tube and, as a result, only a portion of the gas is directed into the enclosure. This reduces the danger of filling the box-like enclosure with large quantities of gas, the ignition of which could have serious consequences.

While this manner of directing the gas into the vicinity of the spark gap does not have the obstructing advantages of the tortuous passage of the FIG. 1–5 embodiment, it does assure atomization of the gas that reaches the spark gap as a result of its impingement upon the wall of the tube 39.

As in the embodiment of the invention illustrated in FIGS. 1–5, the unit shown in FIG. 8 has a torch storage hook 41 pivotally mounted on one of its upright walls, which may be the hinged front wall 38, and — as before — when the torch, here identified by the numeral 5' is lifted from that hook, the valves controlling flow of gas to the torch are automatically opened.

Since the volume of gas projected from a heavy duty cutting torch is considerably greater than that which issues from the smaller brazing torch, any appreciable delay in ignition can result in a startling if not dangerous explosion. To prevent that happening, the opening of the valves 8—8' that control the flow of gas to the torch is delayed for an interval after the torch is lifted from its storage hook 41, long enough to enable the operator to activate the spark gap and insure ignition the instant the gas issues from the torch.

The manner in which this desirable feature is achieved is illustrated in FIG. 10. As there shown, a normally open switch 42 is connected in series with the solenoids of the valves 8—8' so that until that switch closes, no gas can issue from the torch. Closure of switch 42 is effected by energization of the solenoid of a time delay relay 43 which, in turn, requires closure of a switch 44. The switch 44 — like the switch 28 — is closed by depression of the hinged front wall 38; but, because of the time delay incorporated in the relay 43, closure of the switch 42, and consequent opening of the valves 8—8', does not occur the instant the torch is lifted off of its supporting hook.

At the conclusion of the time interval for which the relay is set, the switch 42 and also a switch 45 are closed. The switch 45, being connected in series with the switch 15 by a holding circuit 46, maintains the solenoid of the control relay energized after the switch 44 opens and until the switch 15 is opened by return of the torch to its supporting hook.

Closure of the switch 42 also lights the indicator lamp 16.

Those skilled in the art will appreciate that the invention can be embodied in forms other than as herein disclosed for purposes of illustration.

For instance, instead of having all of the operating and control components contained within the same housing, as they are in the embodiments of the invention depicted in FIGS. 1–5 and 8–10, the torch igniter identified by the numeral 25 and the torch control switch 15, along with its actuator in the form of the torch supporting hook 13, can be contained in one housing or cabinet, while the controls consisting of the gas valves 8–8' in both of these embodiments and the relay 45 in FIGS. 8–10 can be placed in another housing located where size does not present a problem, the two units being electrically connected by a suitable cable.

The invention is defined by the following claims:

1. An igniter for hand-held gas torches of the type having a nozzle from which combustible gas issues, comprising:

A. a box-like enclosure, one wall of which has an access opening;

B. a pair of electrodes across which a spark occurs upon connection of said electrodes with an appropriate source of e.m.f;

C. means mounting said electrodes in the enclosure at a location near said one wall of the enclosure but spaced from the access opening therein; and D. gas flow directing means in the form of a metal cup mounted on said one wall and located in the access opening therein, with the mouth of the cup straddling an edge portion of the access opening and facing towards the pair of electrodes, so that the cup coacts with said one wall to define a passage leading from an entrance at the outer face of said edge portion to an exit at the inner face of said edge portion facing towards the pair of electrodes, whereby a jet of combustible gas issuing from the torch and projected into the entrance of said passage impinges upon the bottom of the cup and is thereby reversed in direction to flow out of the exit towards the electrodes.

2. A torch igniter, comprising:

A. ignition means capable when activated of igniting gaseous combustible fuel issuing from the nozzle of a hand-held torch;

B. control means operatively associated with the ignition means for normally maintaining the same inactive but operable to activate the same;

C. an actuator for said control means movable from an inoperative normal position to which it is biased to an operative position during which movement the actuator, acting through said control means, activates the ignition means, said actuator having a portion thereof positioned to be engaged by the nozzle of a torch as the latter is brought into position to project gas issuing therefrom to said ignition means, so that the actuator can be moved to its operative position to effect activation of the ignition means as a consequence of bringing the torch into position to be ignited; and D. gas flow directing means forming a passage having an inlet and an exit, the latter opening to a zone in the vicinity of the ignition means, said flow directing means having wall means so positioned that a jet of gas issuing from the nozzle of a torch and entering the inlet of the flow directing means will impinge said wall means, so that any unvaporized particles in the gas will be broken up by such impingement before they reach the ignition means.

3. A torch igniter comprising:

A. ignition means in the form of a pair of electrodes across which an electric spark occurs upon closure of an electric circuit by which the electrodes are connectable with a source of e.m.f.;

B. a normally open switch connected in said electric circuit and operable upon closure to activate said ignition means;

C. an actuator for said normally open switch, said actuator having a portion thereof positioned to be engaged by the nozzle of a torch as the latter is brought into position to project gas issuing therefrom to said ignition means, so that the actuator can be moved to its operative position to effect activation of the ignition means as a consequence of bringing the torch into position to be ignited; and D. means forming an enclosure for said pair of electrodes and said switch, said enclosure having a wall with outer and inner sides and a hole therethrough adjacent to the pair of electrodes; and a cup mounted on said wall with its mouth straddled by an edge of said hole and facing but spaced from the pair of electrodes, so that said cup and said wall coact to define a tortuous passageway into the enclosure having an inlet at the outer side of said wall and an exit at the inner side of said wall and facing the electrodes, whereby a jet of gas projected into the inlet of said passageway from the nozzle of a torch held adjacent to the outer side of said wall impinges upon the bottom of the cup and by such impingement is projected out of the exit of said passageway towards the pair of electrodes.

4. In a torch igniter, the combination of:

A. ignition means in the form of (1) a pair of electrodes, (2) circuit means including a normally open switch to connect said electrodes with a source of e.m.f. upon closure of said switch and (3) an actuator by which said switch may be closed;

B. means for supplying gaseous combustible fuel to the torch including solenoid actuated valve means which when open connects the torch with a source of gaseous combustible fuel;

C. means including a normally closed switch for electrically connecting the solenoid of said valve means with a source of current, to thereby effect opening of said valve means;

D. torch supporting means mounted for limited up and down motion and biased upwardly;

E. means operatively connecting said torch supporting means with said normally closed switch to open the same and hold it open as long as the torch supporting means is held in its lowered position by the weight of the torch thereon, whereby removal of the torch from said supporting means allows said normally closed switch to close; and F. means for preventing energization of the solenoid of said valve means until said normally open switch is closed to connect the electrodes with a source of e.m.f.

5. The invention defined by claim 4, wherein said means for preventing energization of said solenoid comprises a time delay relay-controlled switch in series with said solenoid, and means activated by said actuator for effecting energization of the coil of said time delay relay.

6. In a torch igniter having ignition means which when activated is capable of igniting gaseous combustible fuel issuing from a hand-held torch, the improvement comprising:

A. means to supply a combustible gas and oxygen to the torch, said means including separate gas and oxygen valves adapted to be opened and closed;

B. a support for the torch, said support being vertically movable between raised and lowered positions and being biased to its raised position from which it is lowered by the weight of the torch when the torch is placed thereon;

C. means responsive to movement of said support to its raised position to effect opening of said valves; and D. means constraining the valves to sequential opening with the gas valve opening before the oxygen valve opens.

7. The torch igniter of claim 2, wherein said gas flow directing means comprises an open-ended axially straight tube mounted on and passing substantially perpendicularly through a wall of said box-like enclosure, the opposite ends of said tube forming the inlet and exit of the flow directing means, the edge of the inlet end of said tube which is at the outer side of said wall being diagonally disposed with respect to the axis of the tube, so that at diametrically opposite sides of the inlet, the edge thereof is spaced different distances from said wall, so that entry of a jet of gas into the tube is possible along a path generally parallel to said wall and crossing the edge of the inlet that is nearest to said wall, so that such jet of gas impinges upon the wall of the tube opposite the edge of its inlet that is nearest to said wall and has a portion thereof deflected inwardly through the tube towards the ignition means and the remainder thereof deflected outwardly away from said wall.

8. The torch igniter of claim 2, wherein said gas flow directing means comprises a cup having its mouth in juxtaposition to and facing the ignition means, so that a jet of gas issuing from the nozzle of the torch and directed into said cup will impinge upon the bottom of the cup and by such impingement will be projected out of the cup towards the ignition means, to be ignited thereby.

9. The torch igniter means of claim 7, wherein said ignition means comprises:

a pair of electrodes across which an electric spark occurs upon closure of an electric circuit by which said electrodes are connected with an appropriate source of e.m.f, wherein said control means is a normally open switch connected in said circuit, wherein said wall of the box-like enclosure on which said tube is mounted is inwardly depressible, wherein said switch has an outwardly biased actuator button, depression of which closes the switch, and wherein said switch is inside the box-like enclosure and so located that its actuator button bears against said inwardly depressible wall, so that closure of said switch is accomplished by depressing said wall.

10. The torch igniter of claim 3, wherein said cup is seated in said hole.

11. The torch igniter of claim 3, wherein said enclosure is a box-like structure with bottom, top and side walls, wherein said wall on which the cup is mounted is the top wall of the enclosure and has a hinged connection with the rest of the enclosure so that it may be raised and lowered, wherein said switch has an outwardly biased actuator button, depression of which closes the switch, and wherein said switch is so located in the enclosure that the hinged top wall thereof rests upon said actuator button so that closure of the switch is accomplished by depressing the hinged wall.

12. The torch igniter of claim 6, wherein each of said valves is of the solenoid actuated type and opens upon completion of an energizing circuit in which its solenoid is connected, and wherein said means for constraining the opening of the valves to said sequential relationship comprises a delay relay in the energizing circuit of the oxygen valve, so that despite the use of a single switch to control the opening of the valves, they open sequentially.

13. The torch igniter of claim 4, wherein said valve means comprises separate gas and oxygen valves, each having its own solenoid, wherein said normally closed switch controls connection of both solenoids with a source of current; and wherein a time delay relay connected with the solenoid of the oxygen valve assures opening of the gas valve before the oxygen valve is opened.

* * * * *